US009267759B2

(12) United States Patent
Speroni

(10) Patent No.: US 9,267,759 B2
(45) Date of Patent: Feb. 23, 2016

(54) TACTICAL ACCESSORY MOUNT, AIMING DEVICE, AND METHOD FOR SECURING A TACTICAL ACCESSORY TO A PISTOL

(71) Applicant: Walter Speroni, Villa Carlos Paz (AR)

(72) Inventor: Walter Speroni, Villa Carlos Paz (AR)

( * ) Notice: Subject to any disclaimer, the term of this patent is extended or adjusted under 35 U.S.C. 154(b) by 36 days.

(21) Appl. No.: 13/739,904

(22) Filed: Jan. 11, 2013

(65) Prior Publication Data

US 2013/0180152 A1 Jul. 18, 2013

Related U.S. Application Data

(60) Provisional application No. 61/585,686, filed on Jan. 12, 2012.

(51) Int. Cl.

| | |
|---|---|
| ***F41C 27/00*** | (2006.01) |
| ***F41G 1/00*** | (2006.01) |
| ***F41G 11/00*** | (2006.01) |
| ***F41G 1/35*** | (2006.01) |

(52) U.S. Cl.

CPC . *F41C 27/00* (2013.01); *F41G 1/00* (2013.01); *F41G 1/35* (2013.01); *F41G 11/004* (2013.01); *Y10T 29/49826* (2015.01)

(58) Field of Classification Search

CPC ..... F41C 27/00; F41G 1/00; F41G 1/35; F41G 11/004

USPC ..... 42/99

See application file for complete search history.

(56) References Cited

U.S. PATENT DOCUMENTS

| | | | | |
|---|---|---|---|---|
| 1,680,186 | A * | 8/1928 | Von Frommer | 42/106 |
| 3,007,248 | A * | 11/1961 | Detrich | 42/127 |
| 3,037,288 | A | 6/1962 | Detrich et al. | |
| 3,365,801 | A | 1/1968 | De Simone, Jr. | |
| 4,102,053 | A * | 7/1978 | Colwell | 42/136 |
| 5,276,988 | A | 1/1994 | Swan | |
| 5,813,159 | A * | 9/1998 | Kay et al. | 42/113 |
| 5,867,930 | A | 2/1999 | Kaminski et al. | |
| 5,878,503 | A * | 3/1999 | Howe et al. | 42/132 |
| 6,336,285 | B1 | 1/2002 | Baumer | |
| 6,493,978 | B1 | 12/2002 | Perkins | |

(Continued)

OTHER PUBLICATIONS

Neodymium Magnet Physical Properties, Feb. 13, 2010, K&J Magnetics Inc., p. 1.*

(Continued)

*Primary Examiner* — Stephen M Johnson
*Assistant Examiner* — Benjamin Gomberg
(74) *Attorney, Agent, or Firm* — Law Office of Arthur M. Antonelli, PLLC

(57) ABSTRACT

The present invention is directed to a tactical accessory mount and aiming system, which may be magnetically secured to the slide of a pistol. The tactical accessory mount may have a longitudinal axis. The tactical accessory mount further may include a first wall substantially aligned with the longitudinal axis, a second wall spaced from the first wall, and a third wall disposed between the first and second walls. The third wall may include an inner surface with a first opening and a magnet disposed in the first opening. The inner surface and magnet may form a substantially planar surface. The first, second and third walls may form a three sided compartment which is configured and dimensioned to be slidably received on a pistol slide. The substantially planar surface may be positioned to magnetically adhere to the pistol slide and secure the tactical accessory mount to the pistol slide.

24 Claims, 13 Drawing Sheets

(56) References Cited

U.S. PATENT DOCUMENTS

| | | | | |
|---|---|---|---|---|
| 6,725,854 | B1 * | 4/2004 | Afshari | 124/87 |
| 7,204,052 | B2 | 4/2007 | Swan | |
| 7,694,450 | B2 | 4/2010 | Keng | |
| 8,312,803 | B2 | 11/2012 | Oz | |
| 8,468,734 | B2 | 6/2013 | Meller et al. | |
| 2008/0236018 | A1 * | 10/2008 | Halverson | 42/135 |
| 2008/0244953 | A1 * | 10/2008 | Kilic | 42/127 |
| 2009/0126251 | A1 * | 5/2009 | Howe et al. | 42/132 |
| 2010/0175297 | A1 * | 7/2010 | Speroni | 42/114 |
| 2010/0212208 | A1 * | 8/2010 | Sims et al. | 42/111 |
| 2011/0088539 | A1 * | 4/2011 | Oz | 89/1.4 |
| 2012/0180369 | A1 * | 7/2012 | Koesler et al. | 42/132 |
| 2013/0185979 | A1 * | 7/2013 | Fridley | 42/90 |
| 2013/0283660 | A1 * | 10/2013 | Matthews et al. | 42/113 |
| 2014/0109457 | A1 * | 4/2014 | Speroni | 42/114 |

OTHER PUBLICATIONS

Installation Instructions, OS Line, A new concept in laser devices , CAT, Jan. 2010.

* cited by examiner

TACTICAL ACCESSORY MOUNT, AIMING DEVICE, AND METHOD FOR SECURING A TACTICAL ACCESSORY TO A PISTOL

CROSS REFERENCE TO RELATED APPLICATIONS

This application claims the benefit of U.S. patent application Ser. No. 61/585,686 filed on Jan. 12, 2012, the entire disclosure of which is incorporated by reference herein.

FIELD OF THE INVENTION

The present invention generally relates to an apparatus for mounting a tactical accessory to a pistol. More particularly, this invention relates to a magnetic mount and sighting system which are configured and adapted to be deployed on the slide of a pistol. Also, the present invention relates to a method of deploying a tactical accessory mount and sighting system on a pistol.

BACKGROUND

Generally, laser sights for pistols may use a laser to indicate the point of impact of the gun. Although laser sights may be secured to a handgun, a need exits for a laser sight that may be quickly installed on a pistol.

SUMMARY

Hence, the present invention is directed to a tactical accessory mount and aiming system, which may be magnetically secured to the slide of a pistol.

One aspect of the invention relates to a tactical accessory mount having a longitudinal axis for a pistol. The tactical accessory mount further may include a first wall substantially aligned with the longitudinal axis, a second wall spaced from the first wall, and a third wall disposed between the first and second walls. The third wall may include an inner surface with a first opening, and a magnet disposed in the first opening. The inner surface and magnet may form a substantially planar surface. The first, second and third walls may form a three sided compartment which is configured and dimensioned to be slidably received on a pistol slide. The first and second walls may be contoured to interlock with the pistol slide to block relative movement between the tactical accessory mount and the pistol slide in two coordinate directions. The substantially planar surface may be positioned to magnetically adhere to the pistol slide and secure the tactical accessory mount to the pistol slide.

In another aspect of the invention, the first wall may include a plurality of projections that mate with the pistol slide. The plurality of projections may include multiple pairs of opposing ridges which are disposed substantially perpendicular to the longitudinal axis.

In another aspect of the invention, the magnet may be slidably received in the first opening. An adhesive may be disposed between the magnet and the third wall. In another aspect of the invention, the third wall may be overmolded onto the magnet.

In another aspect of the invention, the magnet may have a residual flux density greater than approximately 12 Br and a maximum energy product greater than approximately 36 MGOe. The magnet may be a neodymium magnet. The magnet may be a neodymium magnet selected from the group comprising type N38, N40, N42, N45, N48, N50 or N52. For example, the neodymium magnet may be type N42.

In another aspect of the invention, the tactical accessory mount may include a second opening on the third wall, the second opening being configured and dimensioned to receive a rear sight on the pistol slide.

In another aspect of the invention, the third wall further comprises a deck for supporting a tactical accessory, and a first attachment site for fixing the tactical accessory to the deck. The first attachment site may include a cylindrical post which comprises an internal bore with a threaded sidewall for receiving a fastener. The deck further may comprise first and second opposing sidewalls such that the deck and the first and second opposing sidewalls form a docking structure for receiving a tactical accessory. Additionally, the first and second opposing sidewalls may include second and third attachment sites, respectively. The second and third attachment sites may be aligned along a pivot axis, the pivot axis being disposed substantially perpendicular to the longitudinal axis of the tactical accessory mount. The second attachment site may include a groove in the first opposing sidewall and a bore which intersects the groove and extends into the first opposing sidewall.

In another aspect of the invention, the tactical accessory mount may include a tactical accessory received in the dock, the tactical accessory being secured to the deck with a fastener at the first attachment site. The tactical accessory may include a laser sight. The tactical accessory may further include an optical sight.

Another aspect of the invention relates to a method of securing a tactical accessory to a pistol. The method including providing a tactical accessory mount, placing the tactical accessory mount onto a pistol slide, receiving a rear sight of the pistol into the tactical accessory mount, and adhering, magnetically, the tactical accessory mount to the pistol slide.

DESCRIPTION OF THE DRAWINGS

The accompanying drawings, which are incorporated herein and constitute part of this specification, illustrate an embodiment of the invention, and together with the general description given above and the detailed description given below, serve to explain the features of the invention.

DESCRIPTION

Figure 1:
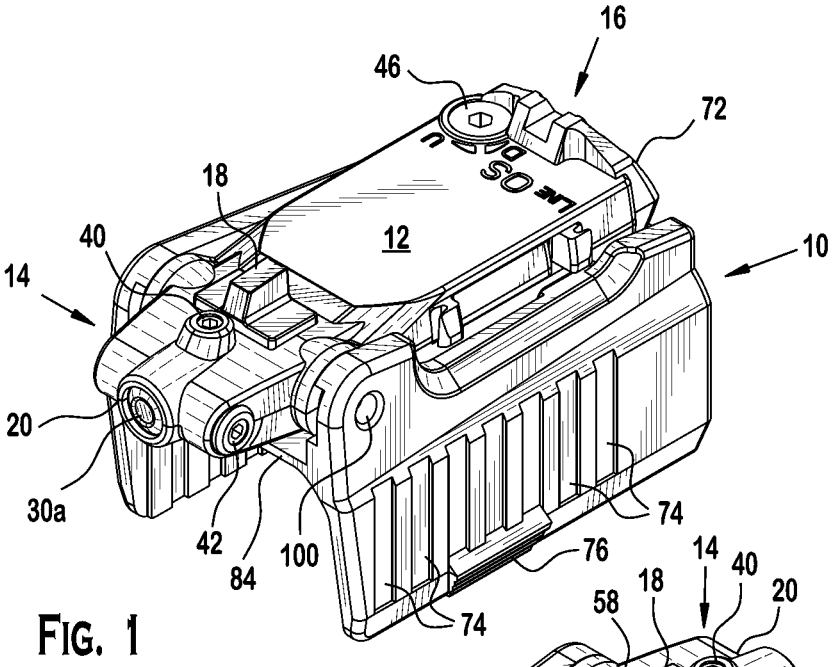
FIG. 1 is a perspective view of an embodiment of a tactical accessory mount and aiming device of the present invention.

FIG. 1 shows an embodiment of a tactical accessory mount 10 and a tactical accessory 12 of the present invention. The mount 10 is configured and dimensioned for attachment to a pistol slide. The tactical accessory 12 may include an aiming device 12. The aiming device 12 may include a laser sighting system 14 and an optical sighting system 15. The optical sighting system 15 may include a rear sight 16 and a front sight 18. Accordingly, the aiming device 12 may have a front end 20 and a rear end 22.

The aiming device 12 may be embodied as a laser and optical sight module. For example, the aiming device 12 may be Part N° OS-779011 (for GLOCK pistols 20, 21, 29, 30) manufactured by CAT Laser, SRL with the standard pistol mounting components removed. The aiming device 12, however, may include a variety of laser or optical sight configurations based on a user's preference, field conditions, or service requirements. For example, the aiming device may include a laser or optical sight configuration that is disclosed in related, commonly owned, co-pending patent application Ser. No. 13/550,545 entitled "Weapon Sighting System" filed on Jul. 16, 2012 (the '545 patent application), which is a CIP of U.S. patent application Ser. No. 29/394,732 filed on Jun. 21, 2011, and which claims the benefit of U.S. patent application Ser. No. 61/507,634 filed on Jul. 14, 2011. The entire disclosure of each of the U.S. patent applications mentioned in this paragraph is incorporated by reference herein.

Figure 12:
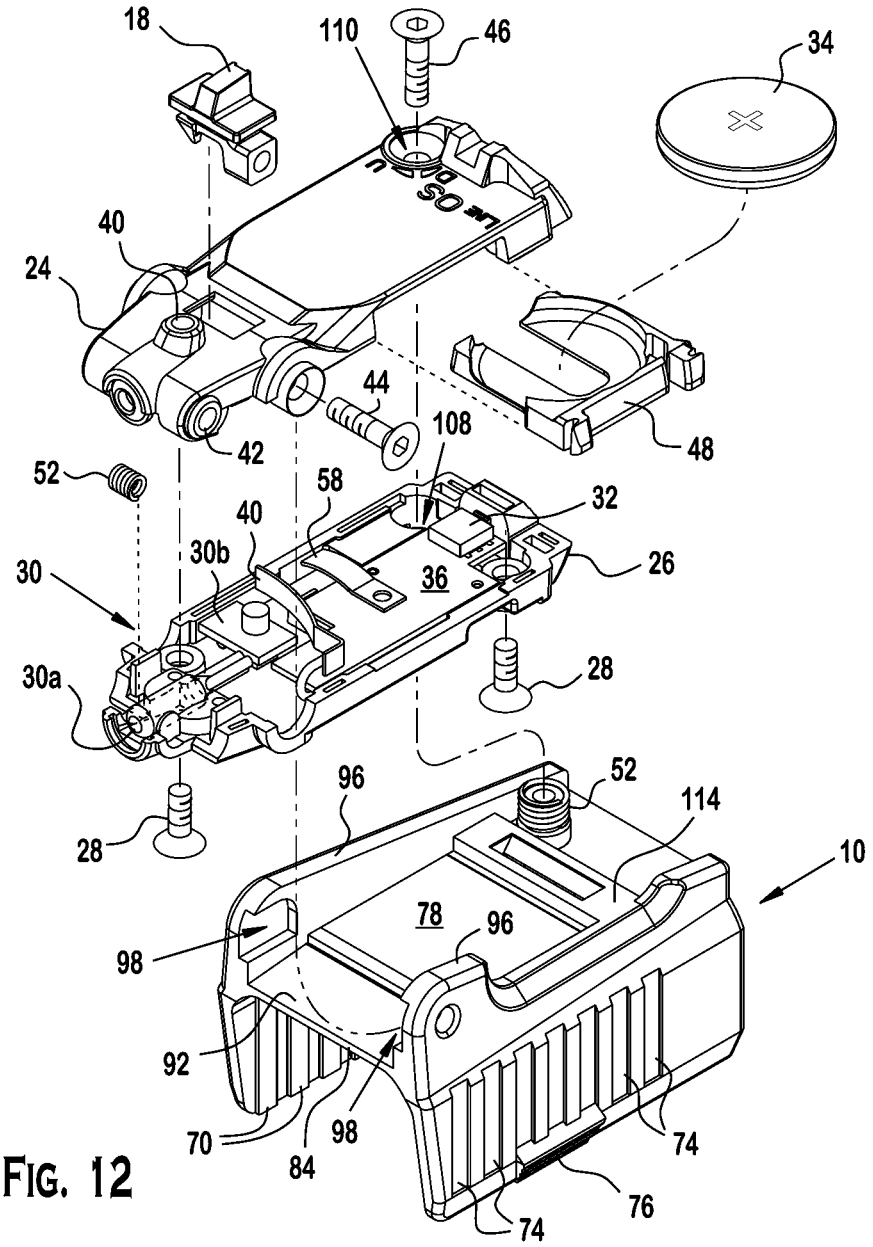
FIG. 12 is an exploded view of selected parts of the mount and aiming device of FIG. 1.
Figure 15:
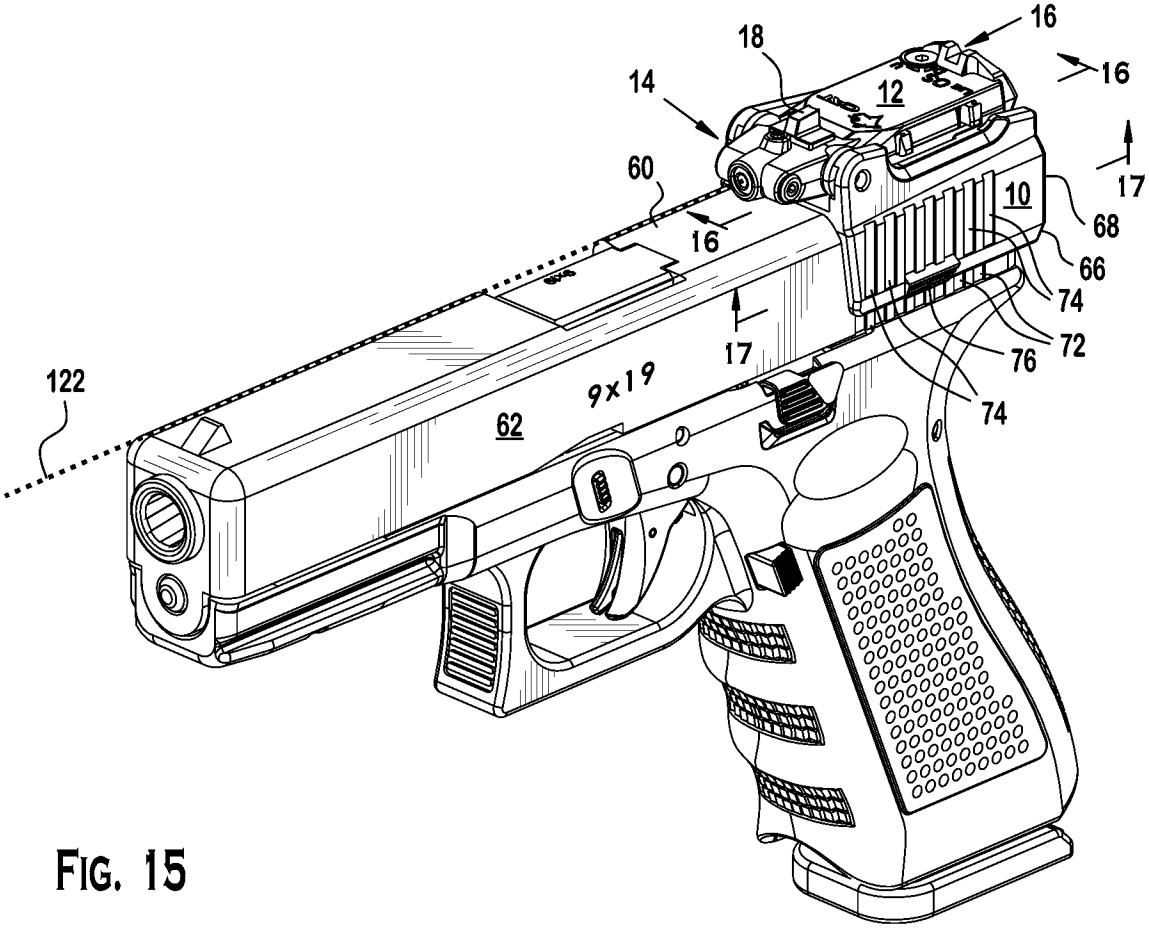
FIG. 15 depicts the mount and aiming device of FIG. 1 disposed on a pistol.

Referring to FIG. 12, the aiming device 12 may include an upper housing 24 and a lower housing 26 that may be fastened together with screws 28 to contain internal components of the aiming device. For example, the internal components may include a laser module 30, which further may include a light emitting diode 30*a* and an integrated circuit 30*b*. The laser module 30 may be controlled by a microcontroller 32 installed within the housing. In addition, a battery 34 for operating the laser module and other electronic components may be contained within the aiming device. For example, the electronic circuit components may include, without limitation, capacitors, resistors, amplifiers, and other semiconductor devices, such as an application specific integrated circuit (ASIC). The electronic components may be disposed on one or more circuit boards 36 and electrically connected to the laser module 30 and battery electrical contacts 38, 40 in order to power and control operation of the laser module 30. As shown in FIG. 15, when turned on, the laser module 30 may emit a laser beam 122 at a wavelength of approximately 635 nanometers to 650 nanometers. Laser beams of other predominate wavelengths may be used in certain applications. The laser beam 122 may be a continuous emission or a pulsed emission.

Referring to FIG. 12, the laser module 30 may be independently adjustable for elevation and windage. The laser module may be adjusted for elevation by changing the vertical elevation (i.e., the z-axis of a Cartesian coordinate system) of the laser module. The laser elevation regulation mechanism 40 raises or lowers the laser module 30 along the vertical axis of the device. For example, a screw mechanism 40 may be used such that turning the knob 40 (or a screw internal to knob 40) clockwise raises the elevation (i.e., increases the value of the z coordinate) of the laser module and turning the knob (or screw) counterclockwise lowers the elevation (decreases the value of the z coordinate) of the laser module.

By contrast, the laser module windage regulation mechanism 42 moves the laser module in a plane perpendicular to the vertical axis (or z-axis). The laser module windage regulation mechanism 42 translates the laser module 30 along the horizontal axis (or x-axis) of the Cartesian frame of reference. The laser module windage regulation mechanism 42 may use a screw mechanism such that turning the knob 42 (or a screw internal to knob 42) clockwise translates the laser module away from the right side of the device (i.e., increases the value of the x-coordinate) and turning the knob (or screw) counterclockwise translates the laser module toward the right side of the device (decreases the value of the x-coordinate).

Similarly, the front sight 18 may be adjustable for windage using another screw mechanism. For example, rotation of screw 44 in the clockwise direction may translate the front sight away from the right side of the device (i.e., increases the value of the x-coordinate) and rotation of the screw 44 counterclockwise may translate the front sight toward the right side of the device (decreases the value of the x-coordinate). Also, the optical sighting system may be adjustable for elevation. For example, rotation of screw 46 in the clockwise direction may raise the elevation (i.e., increases the value of the z coordinate) of the rear sight, and rotation of screw 46 in the counterclockwise direction may lower the elevation (decreases the value of the z coordinate) of the rear sight.

Figure 13:
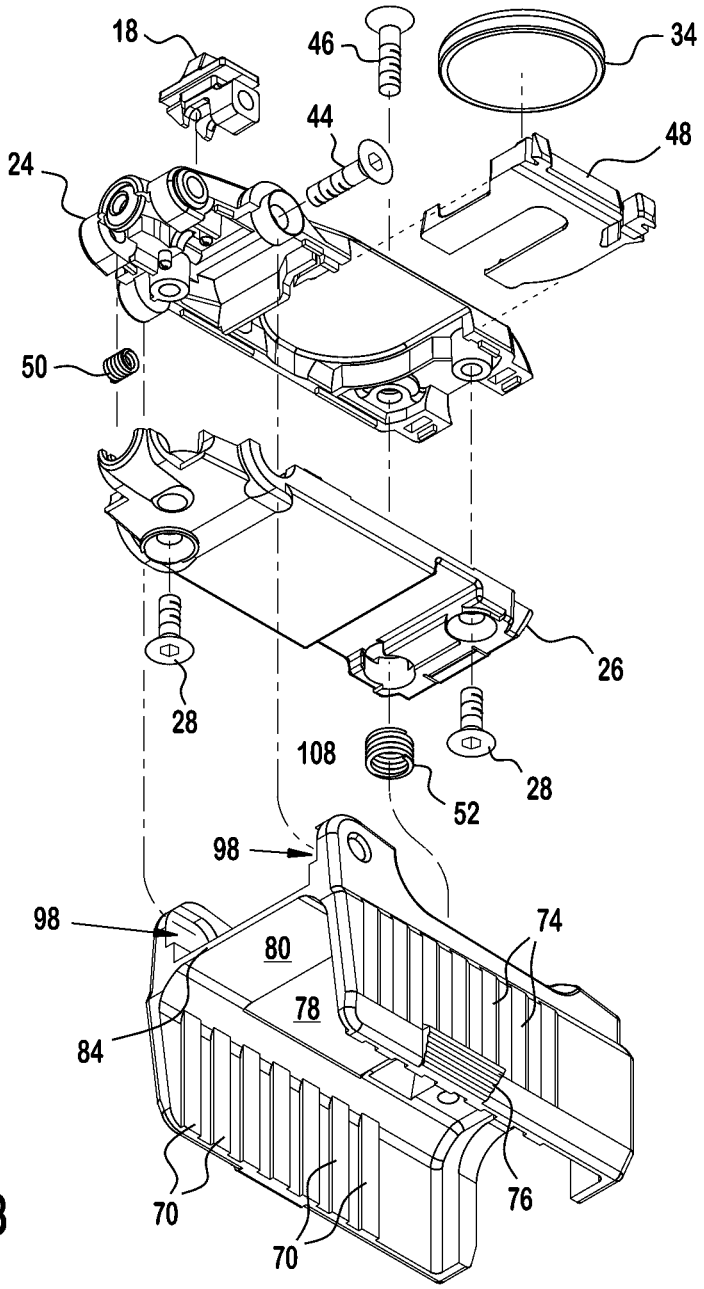
FIG. 13 is another exploded view of the parts of FIG. 12.

Other components of the aiming device 12 are depicted in FIGS. 12 and 13. These components may include a removable battery 48 tray which cradles and positions the battery 34 such that the terminals of the battery connect to the power supply 38, 40 terminals of the aiming device, a laser module windage positioning spring 50, and an optical sight elevation positioning spring 52. Mechanisms for adjusting for laser and optical sights for elevation and windage are discussed in U.S. published application no. 2010/0175297, the entire disclosure of which is incorporated by reference herein.

Figure 3:
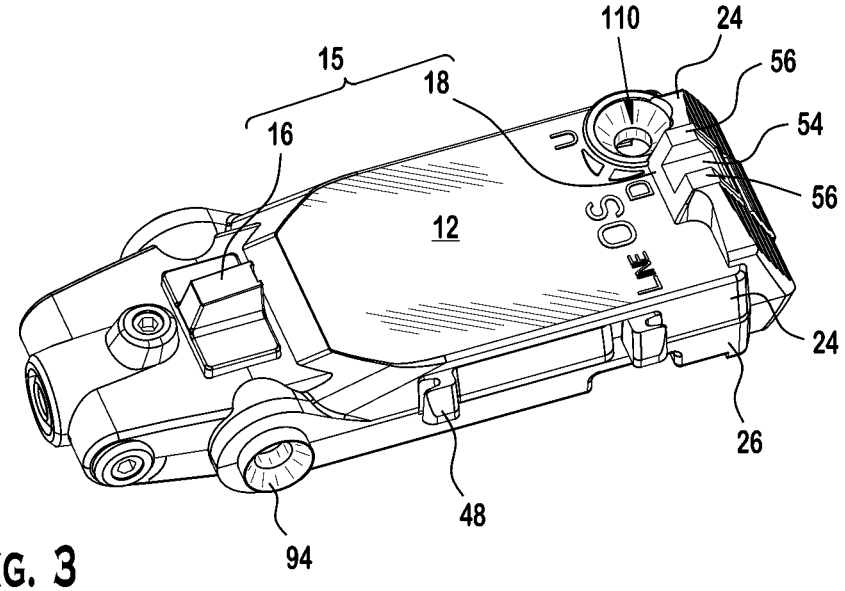
FIG. 3 is a perspective view of the aiming device of FIG. 1.

Referring to FIG. 3, the aiming device 12 may include an optical sighting system 14 that includes a front sight 16 and a rear sight 18. The rear sight 18 may be integral to the upper housing 24 of the aiming device. The rear sight 16 may include a raised central notch 54. Each side 56 of the raised notch may have a width of between 1.4 to 1.6 mm. In a preferred embodiment, each side 56 of the raised notch is 1.5 mm. The raised notch 54 may have a width of approximately 3.2 mm and a depth of approximately 2.0 mm.

Figure 2:
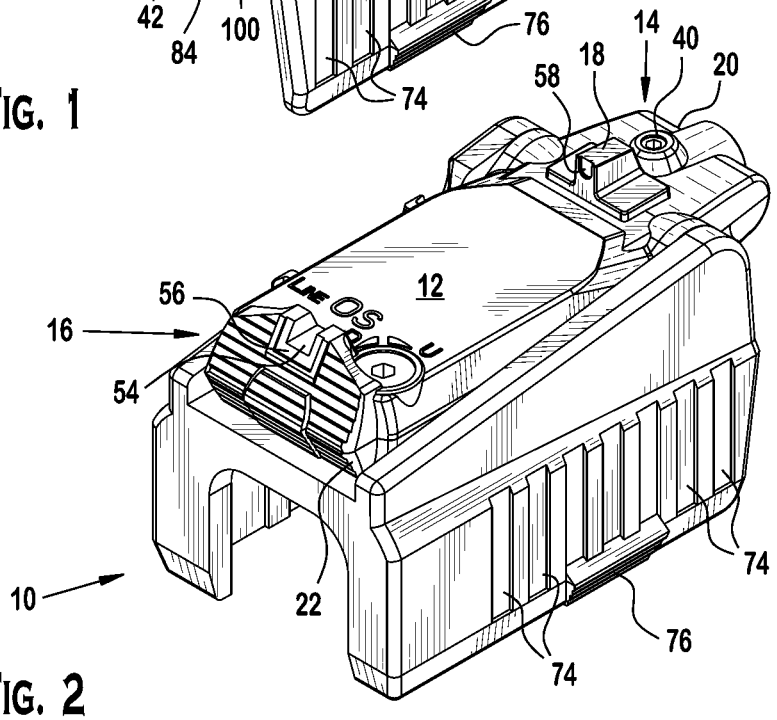
FIG. 2 is a rear perspective view of the mount and aiming device of FIG. 1.

Referring to FIG. 2, the rear side of the rear sight 16 may include a visual guide 56. The visual guide 56 may lead the eye of a user to the raised central notch. The visual guide may include a recessed area (or groove) which frames the notch. The recessed area (or groove) may include a material (e.g., tritium) that provides illumination for enhanced visibility during use in low light conditions.

Figure 11:
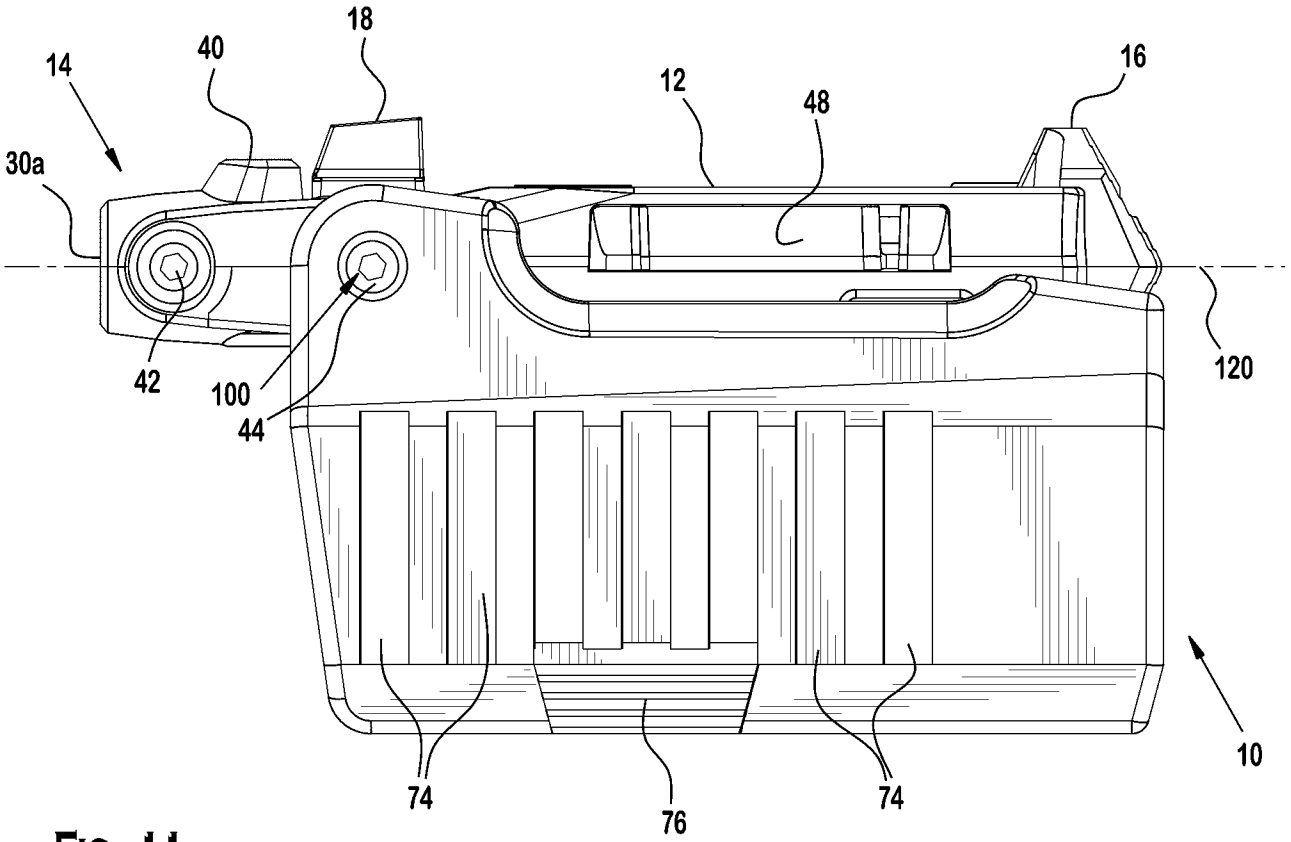
FIG. 11 is a right side view of the mount and aiming device of FIG. 1.

Referring to FIG. 11, the front optical sight 18 is spaced from the rear sight 16 along the longitudinal axis 120 of the device. The front sight 18 may be spaced from the rear sight along the longitudinal axis by a distance of approximately 34.0 mm to 35.0 mm. In one embodiment, the distance between the front sight 18 and the rear sight 16 is 34.5 mm. Also, the front sight 18 may be situated at a slightly higher elevation than the rear sight 16. For example, the front sight may be approximately 0.53 mm to 0.63 mm higher in elevation than the rear sight. In one embodiment, the front sight is approximately 0.58 mm higher in elevation than the rear sight.

Figure 10:
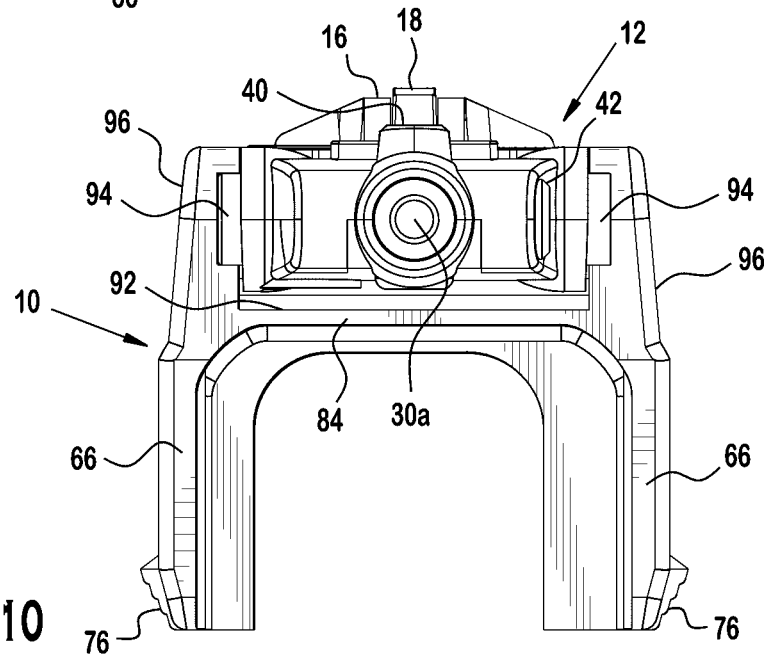
FIG. 10 is a front view of the mount and aiming device of FIG. 1.

Referring to FIG. 10, the front sight 18 may have a width of approximately 2.9 mm to 3.8 mm. In one embodiment, the front sight width may be 2.9 mm. A front sight width of 2.9 mm may be particularly useful for tactical shooting with a pistol at distances ranging from approximately 12 m to approximately 25 m. Referring to FIG. 2, the front sight 18 further may include a recessed portion 58 which extends from the top rear surface of the front sight downward. The recess may be placed such that it is viewable to a user within the notch 54 of the rear sight 16. The effect of the viewing of the recessed portion 58 within the notch 54 may be such that it provides a visual indication of the planar orientation of the optical sighting system, as well as a visual mark for the line of fire. Further, the recessed portion 58 may include a material (e.g., tritium) that provides illumination for enhanced visibility during use in low light conditions.

Referring to FIGS. 12-13, the optical front and rear sights 18, 16 may be independently adjustable to compensate for elevation and windage. The rear sight 16 may be adjusted for elevation by changing the vertical elevation (i.e., the z-axis of a Cartesian coordinate system) of the rear sight. The rear sight elevation regulation screw 46 may raise or lower the rear sight along the vertical axis of the device. For example, a screw mechanism may be used such that turning the screw clockwise raises the elevation (i.e., increases the value of the z coordinate) of the rear sight and turning the screw counterclockwise lowers the elevation (decreases the value of the z coordinate) of the rear sight.

The front sight 18 may be adjusted for windage by changing the horizontal position of the front sight. For example, the front sight windage adjustment screw 44 moves the front sight 18 in a plane perpendicular to the vertical axis (i.e., z-axis). The front sight windage elevation screw translates the front sight along the horizontal axis (i.e., x-axis) of the Cartesian frame of reference. Thus, the front sight windage adjustment screw 44 moves the front sight 18 toward or away from the left side of the device. For example, the front sight windage elevation screw may use a screw mechanism such that turning the screw clockwise translates the front sight away from the left side of the device (i.e., increases the value of the x-coordinate) and turning the screw counterclockwise translates the front sight toward the left side of the device (decreases the value of the x-coordinate).

Figure 5:
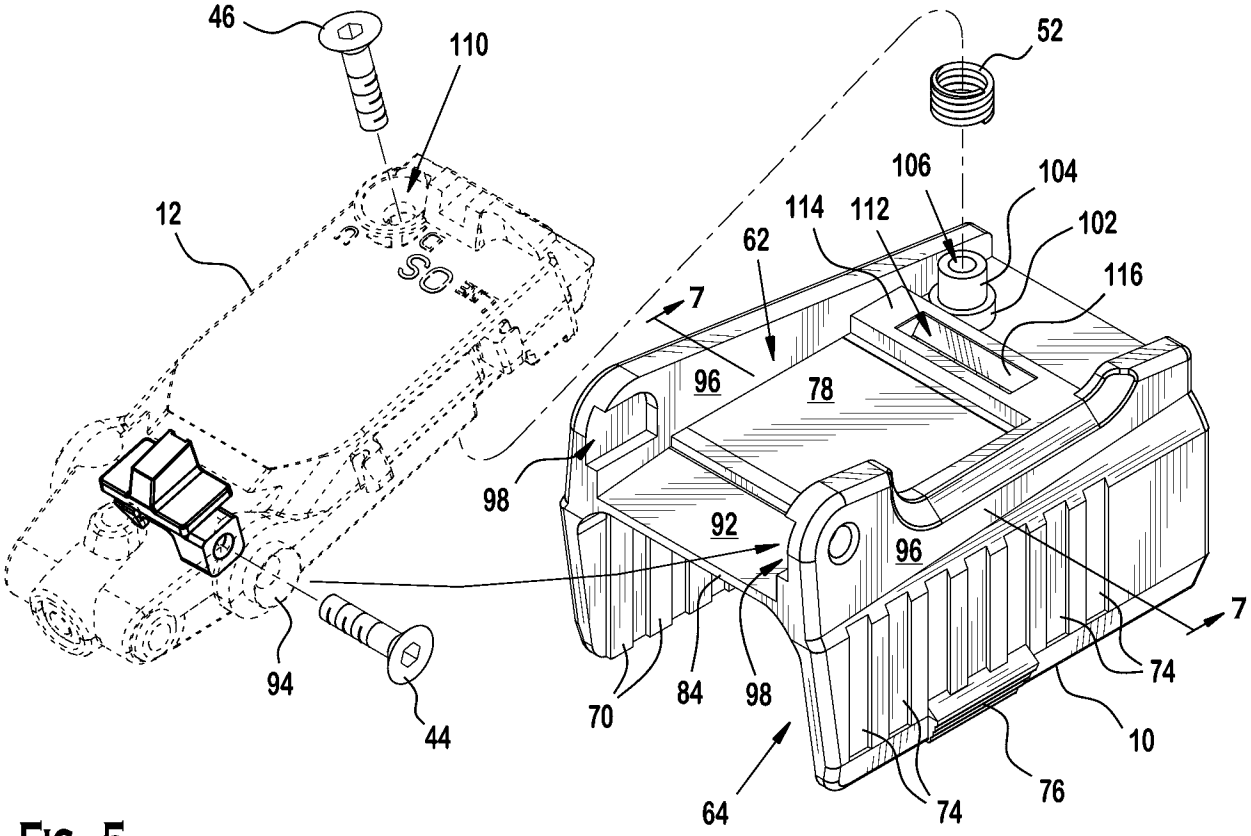
FIG. 5 is a perspective view of the mount of FIG. 1, showing connecting structures for receiving and securing the aiming device to the mount.
Figure 14:
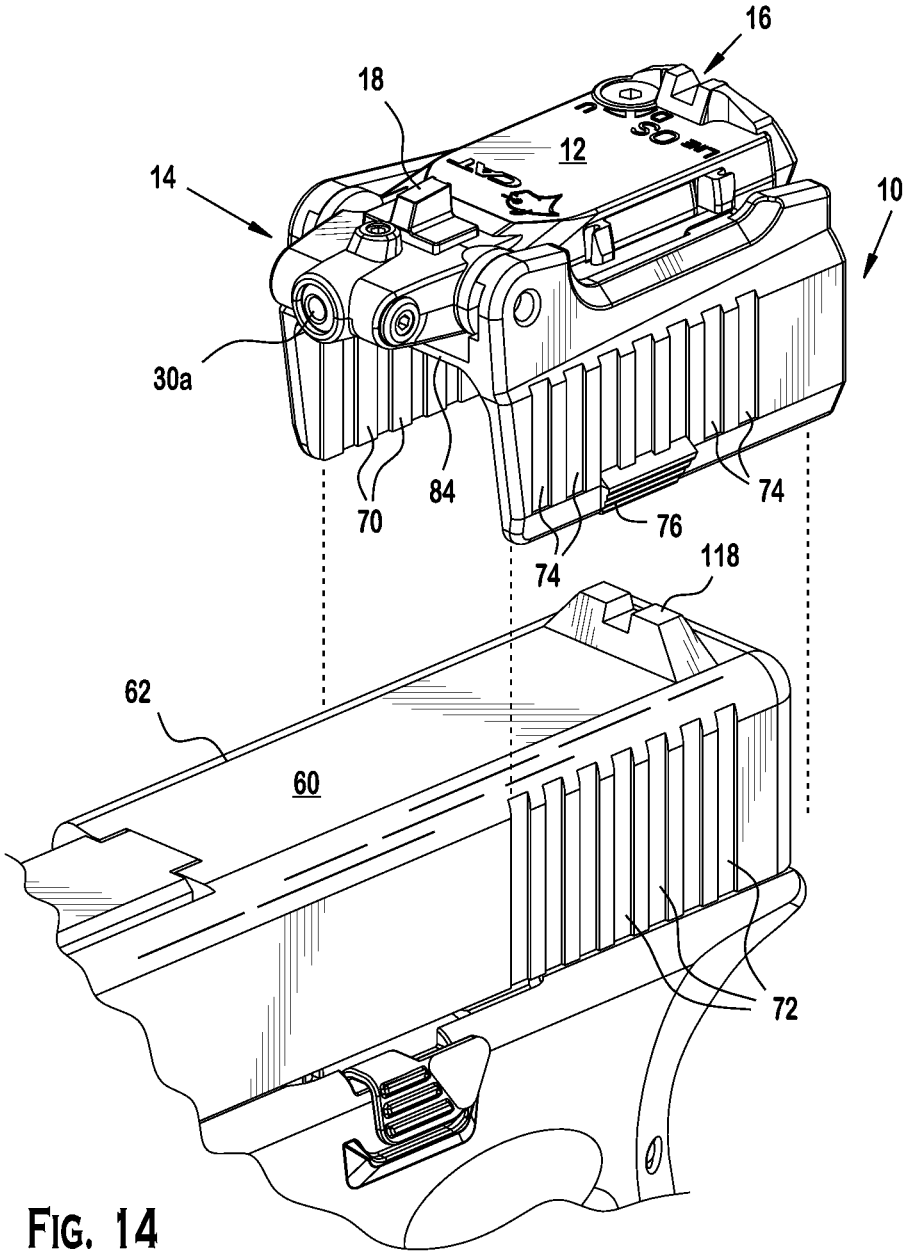
FIG. 14 is a perspective view of the mount and aiming device of FIG. 1, aligned for placement onto a pistol slide.
Figure 16:
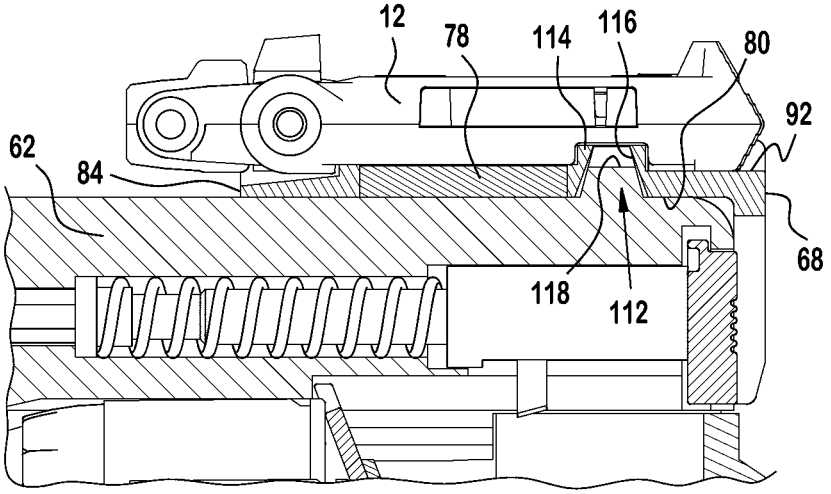
FIG. 16 is a partial sectional view of the tactical accessory mount and pistol of FIG. 15 along line 16-16.
Figure 17:
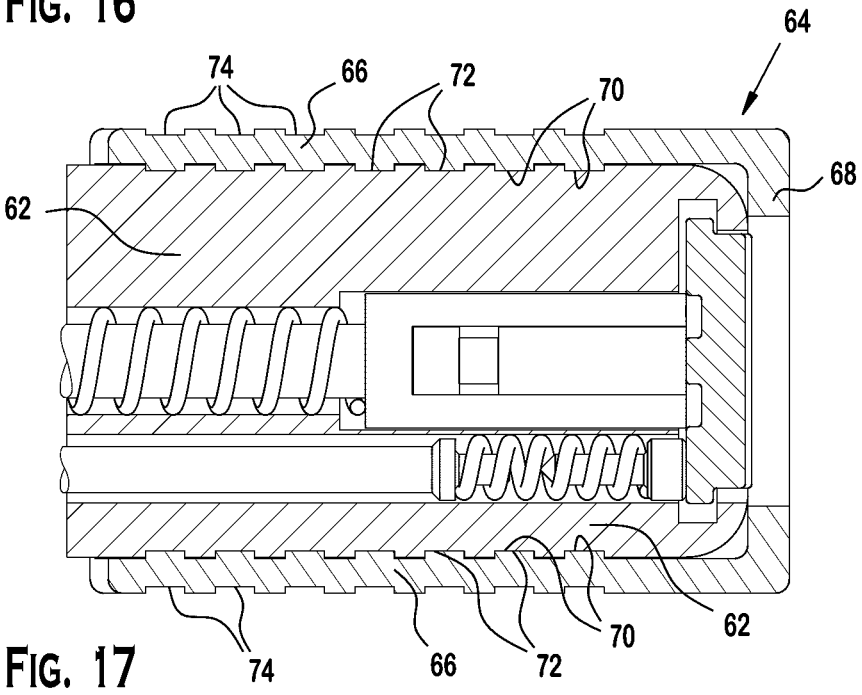
FIG. 17 is a sectional view of the tactical accessory mount and pistol of FIG. 15 along line 17-17.

Referring to FIGS. 1 and 5, the aiming device 12 is disposed on the mount (or base) 10. As shown in FIGS. 14 and 15, the mount 10 is adapted to slide on and magnetically adhere to the top surface of a pistol slide 60. Referring to FIG. 5, the upper portion 62 of the mount is a dock for the aiming device 12. By contrast, the lower portion 64 of the mount 10 may be adapted to securely fit on the pistol as shown in FIGS. 16 and 17. For example, the inside width of the mount 10 may be approximately 25 mm. The inside width of the mount will depend on the width of the pistol slide. Gun slides typically range from approximately 20 mm to 55 mm in width. The height of the mount may range from approximately 30 mm to 35 mm, and the mount may be approximately 50 mm in length.

The mount 10 may be formed from aluminum, other metals or alloys, as well as from polymer materials (e.g., Zytel® HTN51). Mounts made from aluminum, metal or alloy may be painted. Mounts made from a polymer material may be colored. For example, a mount may be black or tan.

As shown in FIG. 17, the lower portion 64 of the mount 10 may include a pair of opposing parallel walls 66 and an end wall 68 disposed between the opposing parallel walls. The opposing parallel walls may include a series of vertical ribs (or projections) 70. The vertical ribs (or projections) may be sized to mate with vertical grooves 72 on the exterior of the pistol slide. The mount may include seven vertical projections 70 on each side wall 66. Although the disclosed embodiments of the mount include seven vertical projections on the inside of each opposing parallel wall, any suitable number or configuration of projections may be used provided the projections conform to the shape of the slide and provide a stable and secure attachment. The exterior surface of each opposing parallel wall may include vertical grooves 74 to improve a user's ability to obtain a secure finger grip on the mounted aiming device when racking the pistol slide. Referring to FIGS. 1 and 2, the exterior surface of each opposing parallel wall may include a larger lateral projection 76 to improve a user's ability to obtain a secure finger grip on the mount 10 when detaching the mount from a pistol slide.

Referring to FIGS. 14, 15 and 17 the vertical projections 70 on the opposing parallel walls 66 of the mount 10 are configured and dimensioned to be slidably received into corresponding vertical grooves 72 on the pistol slide 62. Accordingly, when the mount 10 is seated on to the pistol slide 62, the mount 10 interlocks with the slide 62 to prevent relative movement of the mount and slide in all but one direction. Additionally, the end wall 68, which connects the opposing parallel walls 66, reinforces the structural integrity of the mount.

Figure 6:
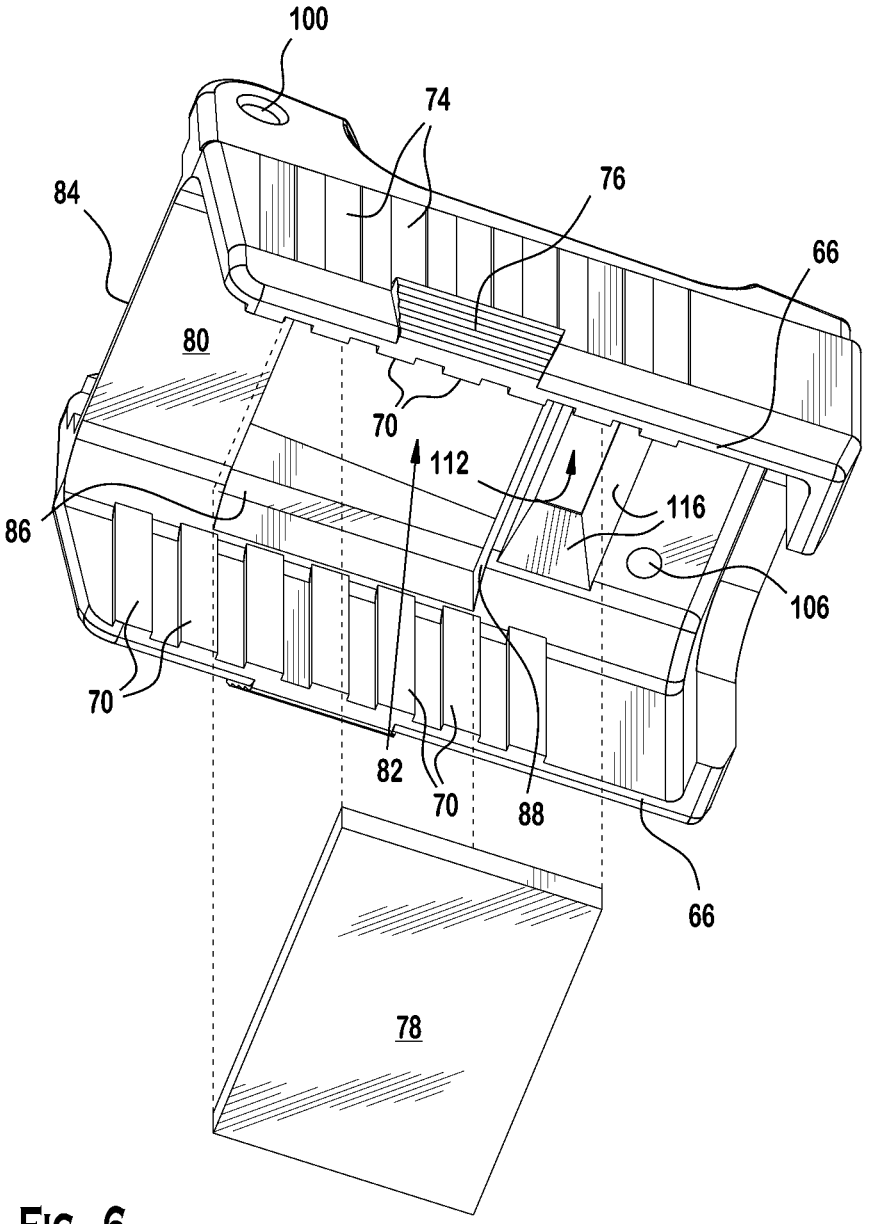
FIG. 6 is a bottom perspective view of the mount of FIG. 1, showing an exploded view of the magnet and mounting receptacle in accordance with an embodiment of the present invention.
Figure 9:
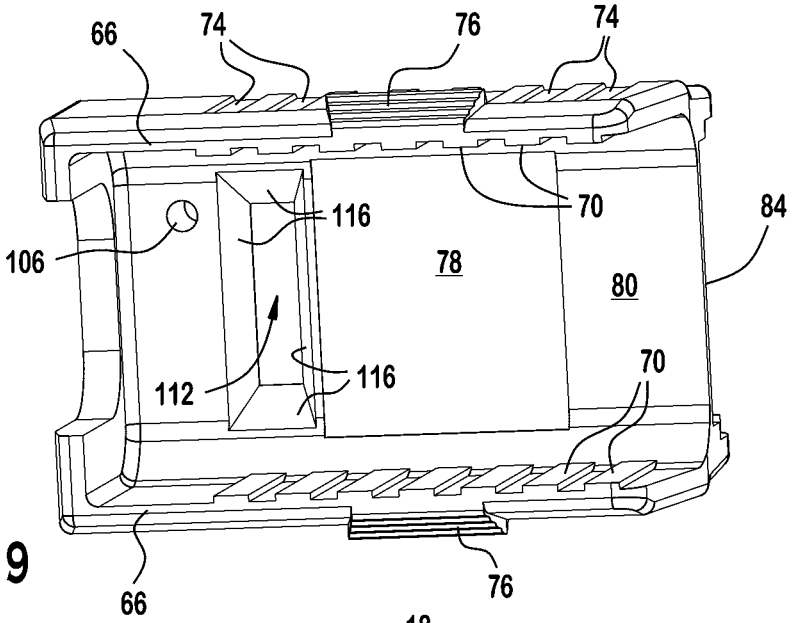
FIG. 9 is a bottom perspective view of the mount of FIG. 1.

Referring to FIGS. 6, 9 and 16, the mount further includes a magnet 78. The magnet 78 may be disposed in the mount 10, such that it forms a portion of the inner surface 80 that connects the opposing parallel walls 66. The magnet may be a grade N42 Neodime (or neodymium) magnet that is manufactured and purchased from DISTRIMAN (www.distriman-.com.ar) of Lugones 2316, Villa Urquiza, Buenos Aires, Argentina. Exemplary dimensions for several magnets that may be used in the mount of FIG. 1 are presented in Table 1 below.

TABLE 1

Exemplary Magnet Dimensions

| Type/Grade | Length (mm) | Width (mm) | Height (mm) |
|---|---|---|---|
| Neodymium, N38 | 28 | 20 | 3 |
| Neodymium, N42 | 27 | 20 | 3 |
| Neodymium, N52 | 25.5 | 20 | 3 |

As shown in Table 1, the magnet 78 may be rectangular, possess a length of approximately 28 mm, a width of approximately 20 mm, and a height of approximately 3 mm. Other magnets may be used as long as the magnet offers sufficient strength to adhere to the slide during gun slide movement caused by shooting. Accordingly, a preferred magnet may be a Neodime magnet (or Neodymium magnet) of grade (or type) N38 to N52 that is of sufficient size to fix the mount to the slide through magnetic attraction power and to resist gun slide movement caused by shooting. In another example, a Neodymium magnet of type N38, N40, N42, N45, N48, N50 or N52 manufactured by K&J Magnetics, Inc.(www.kjmagnetics.com) of 2110 Ashton Dr., Jamison, PA 18929 may be suitable. Exemplary properties of neodymium magnets manufactured by K&J Magnetics, Inc. are presented in Table 2 (below).

TABLE 2

| Exemplary Neodymium Magnet Physical Properties | | |
|---|---|---|
| Type/Grade | Residual Flux Density, Br (KGs) | Max. Energy Product, BH max (MGOe) |
| Neodymium, N38 | 12.2-12.6 | 36-38 |
| Neodymium, N40 | 12.6-12.9 | 38-40 |
| Neodymium, N42 | 13.0-13.2 | 40-42 |
| Neodymium, N45 | 13.3-13.7 | 43-45 |
| Neodymium, N48 | 13.8-14.2 | 45-48 |
| Neodymium, N50 | 14.1-14.5 | 48-50 |
| Neodymium, N52 | 14.5-14.8 | 49.5-52 |

Table Notes:

(a) Brmax (Residual Induction) - Also called "Residual Flux Density." It is the magnetic induction remaining in a saturated magnetic material after the magnetizing field has been removed. This is the point at which the hysteresis loop crosses the B axis at zero magnetizing force, and represents the maximum flux output from the given magnet material. Measured in Gauss in the cgs system, and presented above in Kilo Gauss, KGs.

(b) BHmax (Maximum Energy Product) - The magnetic field strength at the point of maximum energy product of a magnetic material. The field strength of fully saturated magnetic material measured in Mega Gauss Oersteds, MGOe.

Figure 7A:
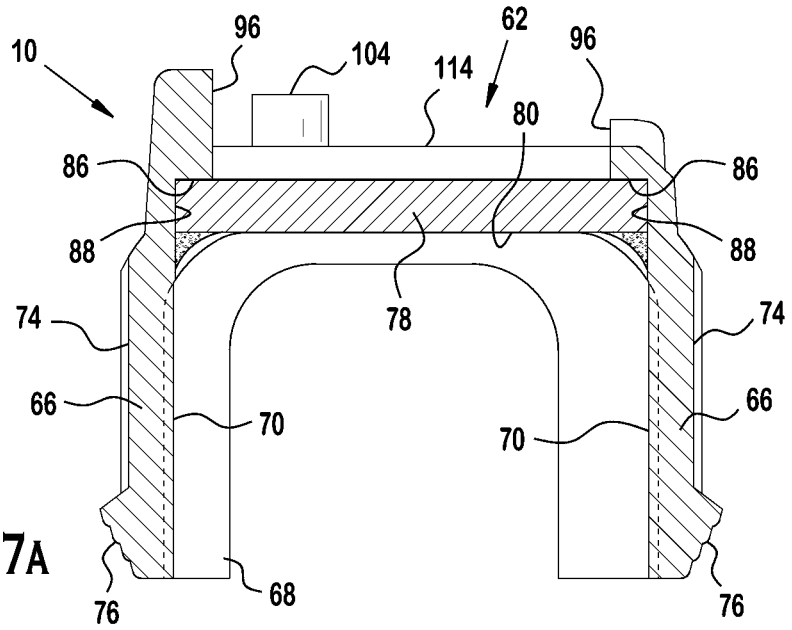
FIG. 7*a* is a sectional view of the mount along line 7-7 of FIG. 5.
Figure 7B:
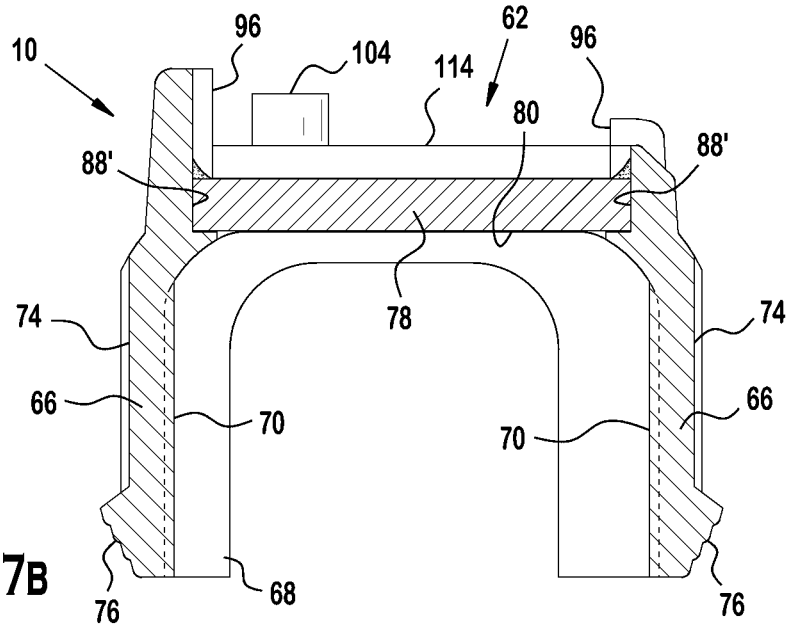
FIG. 7*b* is a sectional view of another embodiment of the mount along line 7-7 of FIG. 5.
Figure 8:
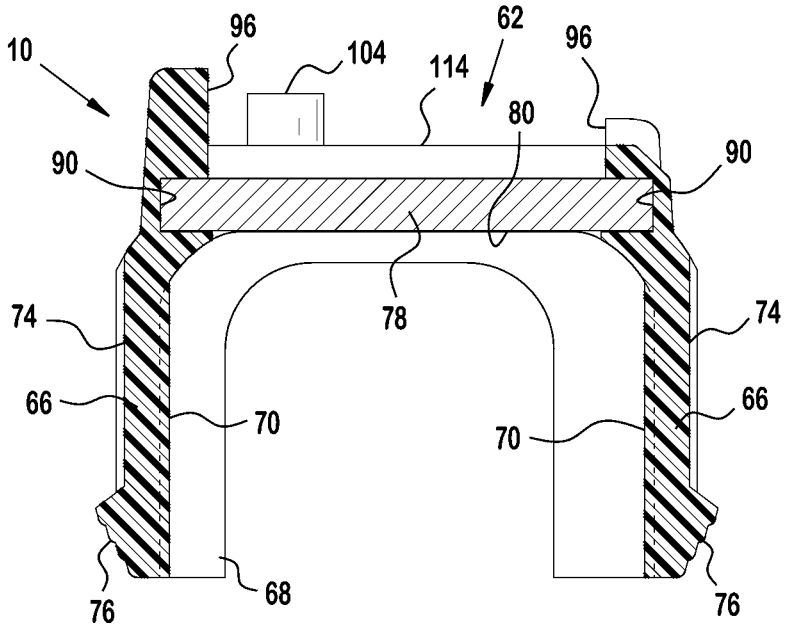
FIG. 8 is a sectional view of another embodiment of the mount along line 7-7 of FIG. 5.

Referring to FIGS. 6 and 7*a*, the magnet 78 may be shaped to key into an opening 82 in the wall 84 that connects between the opposing parallel walls 66 of the mount 10 below the deck. Adhesive, such as, Loctite® 411 may be applied to a bench 86 or adjacent the opening sidewall 88 to secure the magnet within the opening. Alternatively, as shown in FIG. 7*b*, the magnet 78 may be shaped to key into a recess 88' in the upper portion of the mount 62. Moreover, as shown in FIG. 8, a portion of the magnet 78 may be disposed in opposing lateral grooves 90 in the sidewalls of the upper portion 62 of the mount. Although the magnet 78 may be manually inserted into the opposing lateral grooves 90 and glued to the mount, the mount also may be formed about the magnet by an overmolding process.

Although the embodiment of the mount shown in the drawing figures is depicted on the slide of a Glock 20, the mount may be used on a Glock 21, 29 and 30. Additionally, the mount may be modified such that the lower portion is configured and dimensioned to mount on the slide of other pistols, such as, the Glock 17, 19, 22, 23, 25, 26, 27, 28, 31, 32, 33, 34, 35, 37, 38 or pistols manufactured by companies, such as, Beretta, Sig Sauer, or Taurus.

As shown in FIGS. 3, 4, 5 and 10, the aiming device 12 may include a pivot ring 92 on the side of the aiming device. Additionally, as shown in FIGS. 10 and 12, each upper sidewall 96 of the mount may include a front lateral groove 98 and each of the front lateral grooves 98 may be configured and dimensioned to slidably receive one of the pivot rings 94 on the side of the aiming device 12. As shown in FIG. 5, one of the front lateral grooves 98 includes a front sight windage adjustment screw access hole 100 that extends from the sidewall exterior to the interior surface of the front lateral groove 98. The front sight windage adjustment screw hole is aligned with the base of the front sight so that the grooves 98 may be used to secure the pivot rings 94 in the mount, as well as to provide access to the front sight windage adjustment screw 44.

Figure 4:
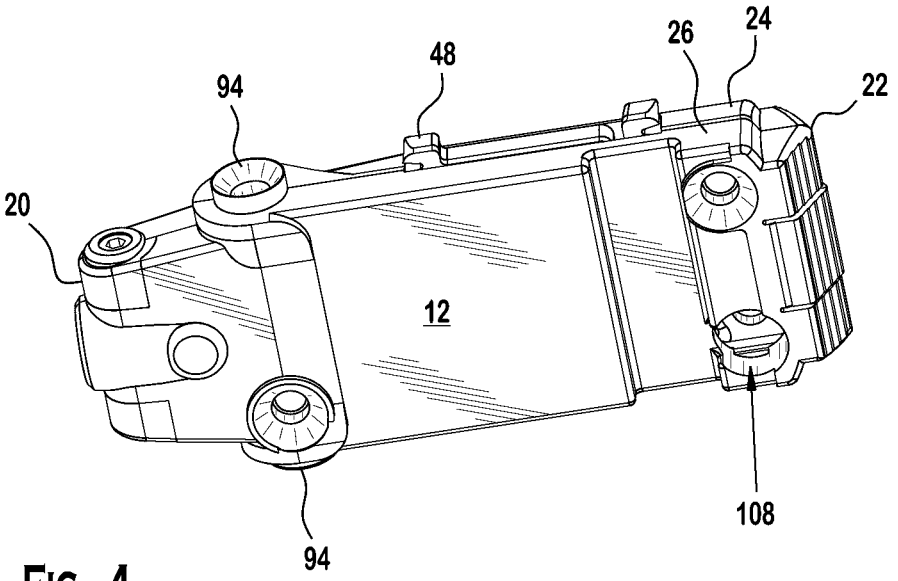
FIG. 4 is a bottom perspective view of the aiming device of FIG. 1.

Referring to FIG. 5, the upper surface of the mount (or deck) 92 includes a rear sight elevation regulation spring base 102 and a rear sight elevation regulation spring stem 104. The rear sight elevation regulation spring stem may be circular cylindrical. A bore 106 may extend from the top surface of the stem 104 to the upper inner surface 80 of the lower portion of the mount (FIG. 9). The bore (or fastener attachment sight) 106 may be threaded or otherwise configured to receive the rear sight elevation regulation screw 46. As shown in FIG. 5, the rear sight elevation regulation spring 52 is placed around the stem 104. Referring to FIGS. 4, 12 and 13, the lower housing 26 includes an opening 108 which is configured and dimensioned to receive the rear sight elevation regulation spring 52 and stem 104. As shown in FIG. 5, the pivot rings 94 of the aiming device 12 are pulled into the pivot ring receiving grooves 98 which are located in the upper, front, opposing inner surfaces 96 of the mount. The aiming device 12 is then rotated about the pivot rings 94 in the receiving grooves 98 until the opening 52 for the rear sight elevation regulation spring and stem is fully seated on the rear sight elevation regulation spring 52 and stem 104. An elevation regulation screw 46 is then inserted into the aiming device rear sight elevation regulation screw hole 110 and advanced into the bore 106 of stem 104 to secure the aiming device to the mount.

Referring to FIGS. 6, 9 and 16, between the magnet 78 and the rear sight elevation regulation fastener attachment sight 106 is an opening 112 that extends from the upper inner surface 80 to the deck 92 (FIG. 16). More particularly, the opening 112 extends to the exterior surface of a rectangular block 114 disposed adjacent the rear sight elevation regulation stem 104. The sidewalls 116 of the opening 112 taper inward from the upper inner surface 80 to the exterior surface 92. Referring to FIG. 16, this opening is configured, dimensioned and spaced from the opposing parallel walls 66 and end wall 68 such that the rear sight 118 of the pistol may be disposed within the opening 112 when the mount 10 is attached to the slide. In this manner, the rear sight of the pistol 118 does not need to be removed in order to accommodate the aiming device 12, as the rear sight of the pistol 118 does not interfere with the structure or functionality of the tactical accessory mount 10 and aiming device 112.

In use, the vertical projections 70 of the mount's inner walls 66 are disposed within the vertical external grooves 74 of the pistol slide 62, the rear sight of the pistol 118 is disposed in the mount's opening 112 for the rear sight, and the mount's magnet 78 contacts the top of the slide 60 to hold the mount 10 onto the slide. To remove the mount 10, the mount is pulled in a direction normal to the top of the slide 60 until the strength of the magnetic connection between the magnet 78 and slide 62 is broken or overcome.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, the lower portion of the mount may be reconfigured to mate with a particular slide and the type, size or strength of the magnet may be modified for use with a particular firearm or ammunition type. Additionally, features and/or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A tactical accessory mount, having a longitudinal axis, for a pistol, the tactical accessory mount comprising:

a first wall substantially aligned with the longitudinal axis, a second wall spaced from the first wall, a third wall disposed between the first and second walls which comprises an inner surface which comprises a first opening, and a magnet disposed in the first opening, the inner surface and magnet forming a substantially planar surface, wherein the first, second and third walls form a three sided compartment which is configured and dimensioned to be slidably received on a pistol slide such that the first and second walls are contoured to interlock with the pistol slide to block relative movement between the tactical accessory mount and the pistol slide in two coordinate directions, and wherein the substantially planar surface is positioned to magnetically adhere to the pistol slide and secure the tactical accessory mount to the pistol slide, and further comprising a second opening on the third wall, the second opening being configured and dimensioned to receive a rear sight on the pistol slide.

2. The tactical accessory mount of claim 1, wherein the first wall includes a plurality of projections that mate with the pistol slide.

3. The tactical accessory mount of claim 2, wherein the plurality of projections include multiple pairs of opposing ridges which are disposed substantially perpendicular to the longitudinal axis.

4. The tactical accessory mount of claim 1, wherein the magnet is slidably received in the first opening.

5. The tactical accessory mount of claim 4, further comprising an adhesive disposed between the magnet and the third wall.

6. The tactical accessory mount of claim 1, wherein the third wall is overmolded onto the magnet.

7. The tactical accessory mount of claim 1, wherein the magnet has a residual flux density substantially equal to or greater than 12 Br and a maximum energy product substantially equal to or greater than 36 MGOe.

8. The tactical accessory mount of claim 7, wherein the magnet is a neodymium magnet.

9. The tactical accessory mount of claim 8, wherein the magnet is a neodymium magnet selected from the group consisting of type N38, N40, N42, N45, N48, N50 or N52.

10. The tactical accessory mount of claim 9, wherein the neodymium magnet is type N42.

11. The tactical accessory mount of claim 1, wherein the third wall further comprises a deck for supporting a tactical accessory, and a first attachment site for fixing the tactical accessory to the deck.

12. The tactical accessory mount of claim 11, wherein the first attachment site comprises a cylindrical post which comprises an internal bore with a threaded sidewall for receiving a fastener.

13. The tactical accessory mount of claim 12, wherein the deck further comprises first and second opposing sidewalls such that the deck and the first and second opposing sidewalls form a docking structure for receiving a tactical accessory.

14. The tactical accessory mount of claim 13, wherein the first and second opposing sidewalls comprise second and third attachment sites, respectively, the second and third attachment sites being aligned along a pivot axis, the pivot axis being disposed substantially perpendicular to the longitudinal axis of the tactical accessory mount.

15. The tactical accessory mount of claim 14, wherein the second attachment site comprises a groove in the first opposing sidewall and a bore which intersects the groove and extends into the first opposing sidewall.

16. The tactical accessory mount of claim 15, further comprising a tactical accessory received in the dock, the tactical accessory being secured to the deck with a fastener at the first attachment site.

17. The tactical accessory mount of claim 16, wherein the tactical accessory comprises a laser sight.

18. The tactical accessory mount of claim 17, wherein the tactical accessory further comprises an optical sight.

19. The tactical accessory mount of claim 1, wherein the tactical accessory mount further comprises a tactical accessory, the tactical accessory being connected to the tactical accessory mount such that the third wall is situated between the tactical accessory and the three sided compartment.

20. The tactical accessory mount of claim 19, wherein the tactical accessory comprises an optical sighting system.

21. The tactical accessory mount of claim 20, wherein the optical sighting system comprises a self illuminating component.

22. The tactical accessory mount of claim 21, wherein the self illuminating component comprises tritium.

23. The tactical accessory mount of claim 20, wherein the tactical accessory further comprises a laser.

24. A tactical accessory mount, having a longitudinal axis, for a pistol, the tactical accessory mount comprising:

a first wall substantially aligned with the longitudinal axis, a second wall spaced from the first wall, a third wall disposed between the first and second walls which comprises an inner surface which comprises a first opening, a second opening, the second opening being configured and dimensioned to receive a rear sight on a pistol slide, and a magnet disposed in the first opening, the inner surface and magnet forming a substantially planar surface, wherein the first, second and third walls form a three sided compartment which is configured and dimensioned to be slidably received on the pistol slide such that the first and second walls are contoured to interlock with the pistol slide to block relative movement between the tactical accessory mount and the pistol slide in two coordinate directions, and wherein the substantially planar surface is positioned to magnetically adhere to the pistol slide and secure the tactical accessory mount to the pistol slide.

* * * * *